US009669289B2

(12) United States Patent
Lee et al.

(10) Patent No.: US 9,669,289 B2
(45) Date of Patent: Jun. 6, 2017

(54) SIMPLIFIED, RAPID PLAY OF BACCARAT-TYPE GAME

(71) Applicants: Dongsun Lee, Las Vegas, NV (US); Daniel L. Sahl, Las Vegas, NV (US)

(72) Inventors: Dongsun Lee, Las Vegas, NV (US); Daniel L. Sahl, Las Vegas, NV (US)

( * ) Notice: Subject to any disclaimer, the term of this patent is extended or adjusted under 35 U.S.C. 154(b) by 137 days.

(21) Appl. No.: 14/789,990

(22) Filed: Jul. 2, 2015

(65) Prior Publication Data

US 2016/0166915 A1 Jun. 16, 2016

Related U.S. Application Data

(60) Provisional application No. 62/089,859, filed on Dec. 10, 2014.

(51) Int. Cl.

| | |
|---|---|
| ***G07F 17/32*** | (2006.01) |
| ***A63F 1/00*** | (2006.01) |
| ***A63F 3/00*** | (2006.01) |

(52) U.S. Cl.

CPC ..... *A63F 1/00* (2013.01); *A63F 3/00157* (2013.01); *G07F 17/3244* (2013.01); *G07F 17/3293* (2013.01); *A63F 2001/001* (2013.01)

(58) Field of Classification Search

CPC ..... G07F 17/32

See application file for complete search history.

(56) References Cited

U.S. PATENT DOCUMENTS

| | | | | |
|---|---|---|---|---|
| 6,719,291 | B1 * | 4/2004 | deKeller | A63F 3/00157 273/274 |
| 2008/0122177 | A1 * | 5/2008 | Kling | A63F 3/00157 273/292 |
| 2008/0303214 | A1 * | 12/2008 | O'Halloran | A63F 1/00 273/274 |

* cited by examiner

*Primary Examiner* — Omkar Deodhar

(74) *Attorney, Agent, or Firm* — Mark A. Litman & Associates, P.A.

(57) ABSTRACT

A faster version of a playing card wagering game similar to baccarat includes, after a wager has been placed on at least one of a player hand winning outcome, a banker hand winning outcome or a tie, dealing exactly one or two cards to a player hand position and an initial single card to a dealer hand position. With two cards to the player position, the banker must receive a mandatory second playing card if the first banker card is a zero value card. With one card to the player position, a higher natural 8 or 9 hand wins. In all other circumstances, a third card is dealt to the lower count hand, and then a resulting higher count hand wins and a tie loses.

15 Claims, 3 Drawing Sheets

SIMPLIFIED, RAPID PLAY OF BACCARAT-TYPE GAME

RELATED APPLICATION DATA

This application claims priority from U.S. Provisional Patent Application Ser. No. 62/089,859, filed 10 Dec. 2014.

BACKGROUND OF THE INVENTION

1. Field of the Invention

The present invention relates to the field of wagering games, wagering games using playing cards or symbols of playing cards to effect random event outcomes in a competitive game having similarities to player versus banker baccarat.

2. Background of the Art

Baccarat is a card game that is dealt from a shoe that holds 6 or 8 decks of cards. Two hands are dealt by the house dealer, the "banker" hand and the "player" hand. Before the hands are dealt, bets may be placed on the banker hand, on the player hand, or on a tie.

Winning bets on banker or player are paid 1:1, but a commission of 5% is charged on bank bets making the net odds on such bets 0.95 to 1. Some casinos may charge a lower commission (e.g., 4%).

Some sources report that tie bets are paid 8:1, while others claim that tie bets are paid 9:1, so this may vary from casino to casino. If there is a tie, bets on the banker or player are returned. Once a bet has been placed, there are no opportunities for further decisions—both the banker hand and the player hand are dealt according to fixed rules, resulting in final hands of either two or three cards for each.

The value of a hand is determined by adding the values of its individual cards. Tens and face cards are counted as zero, while all other cards are counted by the number of "pips" on the card face. Only the last digit of the total is used, so all baccarat hands have values in the range 0 to 9 inclusive. The hand with the higher value wins; if the hands have the same value, the result is a tie.

Rules for the player hand: If the player's first two cards total 6 or more, then the player must stand without drawing a card. If the player's first two cards total 5 or less, the player must draw one additional card.

Rules for the banker hand: If the banker's first two cards total 7 or more, then the banker must stand without drawing a card. If the banker's first two cards total 0, 1, or 2, then the banker must draw one card. If the banker's first two cards total 3, 4, 5, or 6, then whether the banker draws is determined by the whether the player is drew, and if so the value of the player's draw card, as shown by the table below.

Bank Drawing Vs. Player's Draw

| Bank | N | 0 | 1 | 2 | 3 | 4 | 5 | 6 | 7 | 8 | 9 |
|---|---|---|---|---|---|---|---|---|---|---|---|
| | D indicates that the player MUST draw a card | | | | | | | | | | |
| 9 | — | — | — | — | — | — | — | — | — | — | — |
| 8 | — | — | — | — | — | — | — | — | — | — | — |
| 7 | — | — | — | — | — | — | — | — | — | — | — |
| 6 | — | — | — | — | — | — | — | D | D | — | — |

-continued

| Bank | N | 0 | 1 | 2 | 3 | 4 | 5 | 6 | 7 | 8 | 9 |
|---|---|---|---|---|---|---|---|---|---|---|---|
| | D indicates that the player MUST draw a card | | | | | | | | | | |
| 5 | D | — | — | — | — | D | D | D | D | — | — |
| 4 | D | — | — | D | D | D | D | D | D | — | — |
| 3 | D | D | D | D | D | D | D | D | D | — | D |
| 2 | D | D | D | D | D | D | D | D | D | D | D |
| 1 | D | D | D | D | D | D | D | D | D | D | D |
| 0 | D | D | D | D | D | D | D | D | D | D | D |

D = draw, N = no card drawn by player

The probability distribution for a hand dealt from a complete shoe is as follows:

| | Probability of bank win | Probability of of player win | Probability of tie |
|---|---|---|---|
| 6 decks | 0.458652719 | 0.446278570 | 0.095068711 |
| 8 decks | 0.458597423 | 0.446246609 | 0.095155968 |

This implies the following house advantages:

| | Bet bank | Bet bank | Bet player | | | |
|---|---|---|---|---|---|---|
| decks | 5% vig. | 4% vig. | 9:1 | 8:1 | Bet tie | Bet tie |
| 6 | 1.05585% | 0.59720% | 1.23741% | | 4.93129% | 14.43816% |
| 8 | 1.05791% | 0.59931% | 1.23508% | 4.84403% | 14.35963% | |

It has been determined that card counting is not significantly effective in overcoming the house edge at the baccarat tables. Compared to blackjack, card counting is about 9 times less effective when used against baccarat.

As widely played as baccarat is, there is still some 'mystery' or ambivalence to the play rules, especially when 'hit' rules are used and the player has no control. There is enough of a concern to the rules that some improvement and simplification in rules may be desirable to offer an improvement that would attract more players and increase the comfort level in players.

SUMMARY OF THE INVENTION

A faster version of a playing card wagering game similar to baccarat includes, after a wager has been placed on at least one of a player hand winning outcome, a banker hand winning outcome or a tie, dealing exactly two cards to a player hand position and an initial single card to a dealer hand position. The banker must receive a mandatory second playing card if the first banker card is a zero value card. Differing payout odds are paid on a banker hand wager when the banker hand winning outcome is accomplished with one card (1:1) odds versus two cards (1:2 or 1:1 odds). The player hand may never take an additional card.

DETAILED DESCRIPTION OF THE INVENTION

Figure 1:
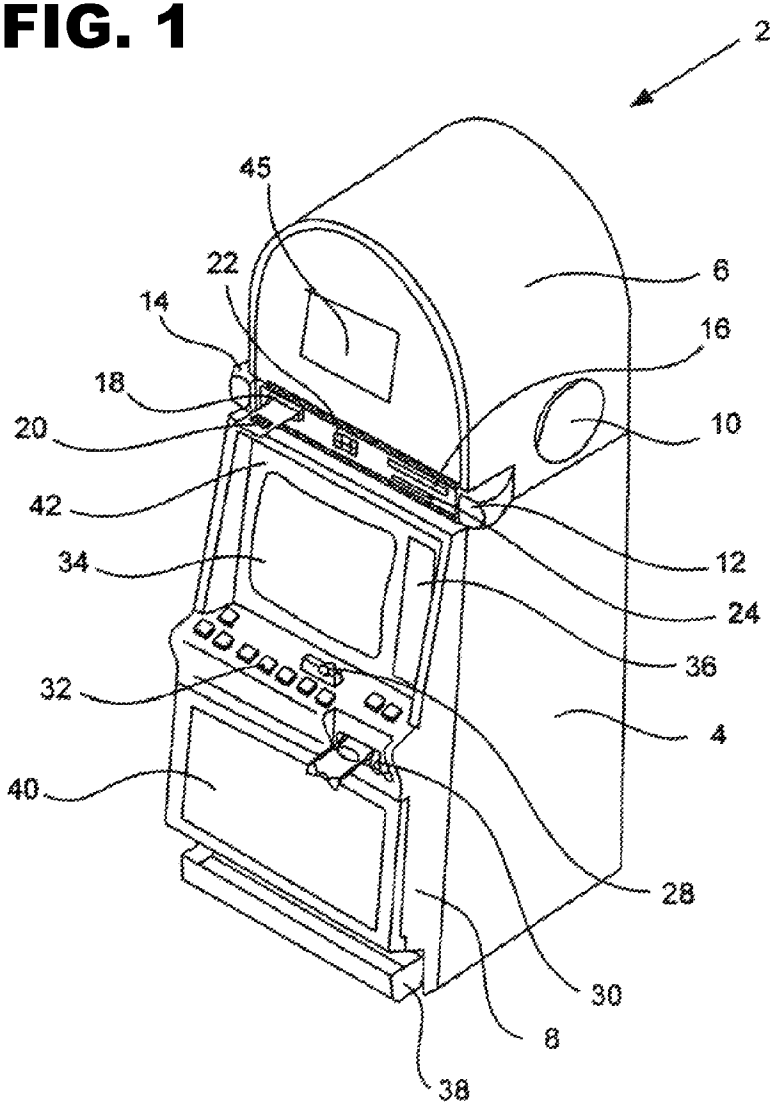
FIG. 1 shows an electronic gaming table on which the gaming method may be executed.

A faster version of a playing card wagering game similar to baccarat includes, after a wager has been placed on at least one of a player hand winning outcome, a banker hand winning outcome or a tie, dealing exactly two cards to a player hand position and an initial single card to a dealer hand position. The banker must is receive a mandatory second playing card if the first banker card is a zero value card. Differing payout odds are paid on a banker hand wager when the banker hand winning outcome is accomplished with one card (1:1) odds versus two cards (1:2 or 1:1 odds). The player hand may never take an additional card.

Fast Baccarat Rules:

Player (either with tokens, chips, currency or the like in a table game; or with credit in an electronic gaming machine version)) may choose to bet on the Player hand, the Banker hand or a Tie event.

As in traditional Baccarat and mini baccarat, the dealer (or electronic computer acting as a virtual dealer) will deal one hand for the player and one hand for the Banker using the following drawing rules:

The player hand is always dealt two cards. These cards are scored using the traditional Baccarat scoring method, with the numerical value of all cards in a hand summed (with 10, Jack, Queen and King being zero value) and only the last digit (the unitary value digit) being considered.

The Banker hand is initially dealt one card. If the first card has a point value of 1 or greater (A,2,3,4,5,6,7,8,9), the Banker will stand with that point value.

If the first card drawn for the Banker has a point value of 0 (10,J,Q,K), the dealer must draw a second card. The value of the second card will be the point value of the Banker's hand.

Player Outcomes:

If the player's hand two-card total beats (is higher than) the banker's hand one-card is or mandatory two-card final total, the player's wager on the player hand will pay even money.

If the player's hand has a two-card total of 9 and beats the dealer's one-card or mandatory two-card final total, the player wager on the player hand will pay 3 to 2.

If the player hand has a two-card total that is equal to the Banker's one-card or two-card final total (other than with a one-card total of zero), the player wager will push.

If the player hand has a two-card total that is less than the Banker's hand one-card or mandatory two-card final total, the player wager on the dealer hand is lost.

A player may place on a single one of the player hand wager and the dealer hand wager, but may also place a tie wager.

Banker Hand Outcomes

If the Banker's hand final one-card total or two-card total is greater than the Player's hand two-card total, a Banker wager will be paid even money.

In an alternative play, if the Banker's hand final two-card total is greater than the Player's two-card total, a Banker wager will be paid 1 to 2.

If the Banker's hand one-card or two-card total is equal to the Player's two-card total, a Banker wager will lose with one exception:

a) If the Banker final hand is two zero-point cards, giving the Banker a total point count of zero, the Banker wager will be paid even money if the Player also has a final two-card point total of zero instead of push.

If the Banker's final hand one-card or two-card total is less than the Player's two-card total, the Banker wager is lost.

Ties.

If the final Player and Banker point total is equal, a tie wager will pay 8-1.

Possible Variations:

Player wager can be on Player hand only. Each player in a multiple player position table gets their own two cards vs the dealer's hand one or two cards.

Advantages Over Traditional and Mini Baccarat:

Faster to deal.

Drawing rules are more simple.

There is now a big difference between playing Player vs Banker. Player has lower hit frequency but pays 3 to 2 on a 9 win. Banker hand has a higher win frequency than the Player hand but loses ties instead of pushing (with the exception of a zero-zero tie).

Alternative descriptions of the method and system enabling it are as follows.

A method of playing a simplified wagering game using playing card symbols to determine a random event outcome may include:

a) recognizing a wager on a player hand win, a banker hand win or a player hand-banker hand tie event according to final digit point count in the player hand and the banker hand;
b) providing exactly two random standard playing cards face-up to a player position;
c) providing exactly one first random standard playing card face-up to a banker position;
d) providing exactly one additional random standard playing card face up to the banker position only when and always when the exactly one first random standard playing card is a no-value playing card of a 10, Jack, Queen or King;
e) summing up point count in each of the player hand and the banker hand separately, and valuing the player hand and the banker hand according to a last digit only in summed up point count;
f) determining outcomes in a comparison between the player hand and the banker hand as follows:
   i) a higher summed up point count in the player hand as compared to the summed up point count in the banker hand is a winning outcome for the player hand;
   ii) a higher summed up point count in the banker hand (whether from a one-card only hand or a two-card hand) as compared to the summed up point count in the player hand is a winning outcome for the banker hand;
   iii) an identical summed up point count in the player hand as compared to the summed up point count in the banker hand is a tie outcome for both the player hand and the banker hand;
g) resolving all wagers with payout odds in a) according to outcomes i), ii) or iii) determining the outcome of the wagers.

The method of resolving each of wagers determined by i) and ii) are resolved with is 1:1 odds when the player hand has a higher count than the banker hand, with 1:1 odds when the banker hand count with a single card is higher than the player hand count, and with 1:2 or 1:1 odds when the banker hand count is higher than the player hand count with the mandatory two cards. The resolution of the wagers is determined by i) is always resolved with 1:1 odds for a winning outcome and a wager resolved by ii) is resolved with 1:1 when the banker hand has a winning outcome with only a single card and less than 1:1 when the banker hand count with the two mandatory cards is higher than the player hand count. The wager determined by iii) is resolved with odds of at least 7:1 and usually at least 8:1.

Alternative Wagering Procedures

Set Up

The game is again played using Baccarat point scoring rules. The game must be played with a minimum of 6 decks.

The Wagering:

Bettor makes either a player or a banker wager.

The Deal:

Player and Banker hand both receive one card each:

If either the player or the banker hand have a natural 8 or 9 and beat the point value of the other hand, no further cards are drawn and the winning hand pays even money.

If neither the player nor the banker hand have a natural 8 or 9, a third and final card is drawn and given to only the hand with the lowest point value. The hand with the highest final point value or point total wins the hand. A tie in point values is a push, or may be a loss (full wager) or partial loss (loss of half the wager) on any wager.

If both the player and the banker's first card have an identical point value, the dealer draws the third card and places it between the two hands. If the value of the third card is a specific, preselected value (e.g., here arbitrarily chosen as 4), both hands lose. If the value of the third card is any other value (0,2,3,5,6,7,8,9) the both player and banker push. This rule produces the house advantage.

When dealing from eight shuffled decks, the house advantage for both the player and banker side is 1.12%

Advantages: Commission free. Very fast game. Both player and banker bet have identical house advantage. Card counting for advantage play is impossible.

Lucky 8 Insurance Bet:

When both player and banker are dealt a card with an identical point value, the dealer will offer the opportunity to make an insurance wager before the third card is revealed. Both on the player wager and the banker wager, a bettor can wager up to the full amount of their initial wager (the insurance wager cannot exceed initial wager).

If the dealer draws the preselected card value (in this case the example of a 4), the insurance wager pays 2 to 1 and the main wager is lost. If the dealer draws another preselected playing card value (in this case arbitrarily an 8), the insurance wager pays 8 to 1 and the main wager is pushed. If the dealer draws any other card, the insurance wager is lost and the main wager is pushed. The insurance wager has a house advantage of 7.25% and a hit frequency of about 15.5%.

Advantages of insurance bet: Chinese gamblers do not want to place a wager on the 4, but at the same time might want to protect against an unlucky 4 during a tie. The insurance bet offers a modest pay on the four, but gives a much bigger payout for a lucky 8. So players are not so much betting on the four as they are betting on the 8, (and if the four happens to be drawn, at least they don't lose their money). The insurance bet also works well if players choose to place ½ of their initial fast-baccarat wager. If the third card drawn is a 4, the insurance bet will pay 2 to 1 and cover the loss of the initial wager. If the third card is an 8, the player will receive a nice bonus payout.

The method may be practiced wherein playing card symbols are provided by provision of random physical playing cards provided from a randomized source of physical playing cards, and the physical playing cards are placed one-at-a-time from the source of physical playing cards to respective player hand position and banker hand position. The random cards may be provided by a number of commercially available systems. Among those systems are a pre-randomized set of playing cards brought to a gaming table. Shuffling machines or randomization machines may internally randomize a complete set of playing cards and then deliver all or portions of the randomized set to a delivery mode, or the randomized set may be transferred to a delivery tray or shoe. Shuffling machines or randomization machines may distribute playing cards into individual or multiple collective compartments and slots (with or without card-reading identifying the playing cards in each compartment or slot), and then individual random cards or subsets of random cards (e.g., 2, 3, 4, 5, 6, 7, etc.) are delivered as needed to a delivery tray. In other shuffling or randomization systems, a set of playing cards is provided and random cards are removed from the set of playing cards for delivery (e.g., random ejection shufflers). These systems may be used, preferably with card reading capability in the performance of the wagering events.

In preferred terminology, when an original (first) set of playing cards is used at the beginning of a new wagering event (whether or not that first set was complete, as with all six initial decks, or partial, after playing cards have been removed from a previous wagering event), removal of playing cards further reduces the set as to a second set of playing cards (the first set minus the cards recently delivered, as to the player hand), and then the second set s further reduced to a third set by removal/dealing of playing cards to the banker or dealer hand.

A system enabling the method may include a player table with indicia marking a player hand position and a banker position, indicia marking a wagering position for a player hand winning outcome, a banker hand winning outcome a tie outcome, and a source of random physical playing cards from which playing card symbols are provided to each of the player hand and the banker hand.

A system enabling the method of claim 1 comprising an electronic gaming machine comprising a housing, a video display, a processor, player table with indicia marking a player hand position and a banker position, indicia marking a wagering position for a player hand winning outcome, a banker hand winning outcome a tie outcome, and a source of random physical playing cards from which playing card symbols are provided to each of the player hand and the banker hand.

Turning next to FIG. 1, a video gaming machine 2 that may be used as the underlying base gaming counsel of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40, There may be an overlay of touchscreen functionality on the separate electronic game 40 or some of the buttons 32 may be functional on the separate mechanical gaming system 40. That separate mechanical gaming system may be in a relatively vertical viewing position as shown or in a more horizontal (table like) display unit. Viewable through the main door is a video display monitor 34 and an information panel 36. The display monitor 34 will typically be a cathode ray tube, high resolution flat-panel LCD, LEI), plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming to machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1A:
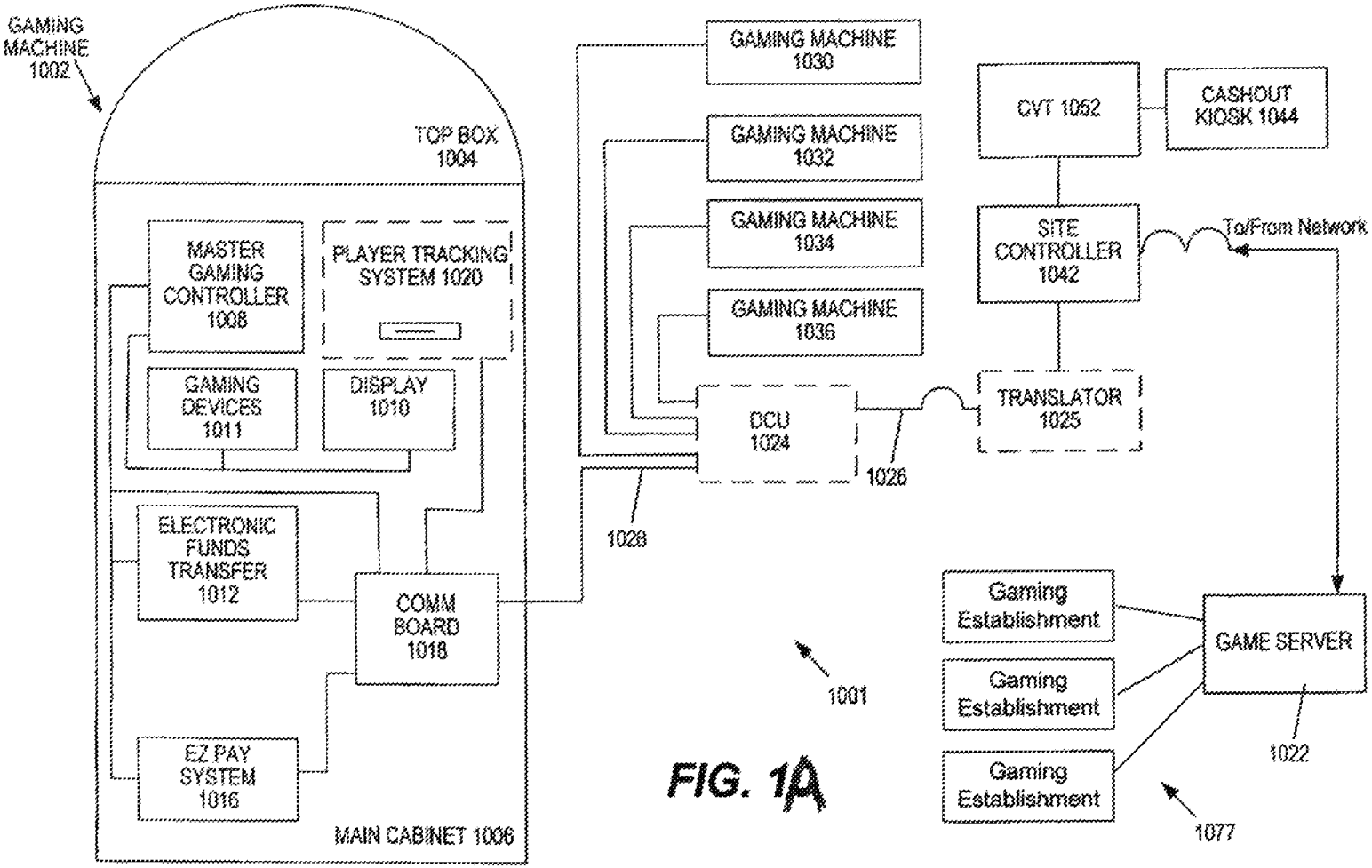
FIG. 1A shows a schematic for an electronic system for enabling play of the gaming method described herein.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022. Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 1B:
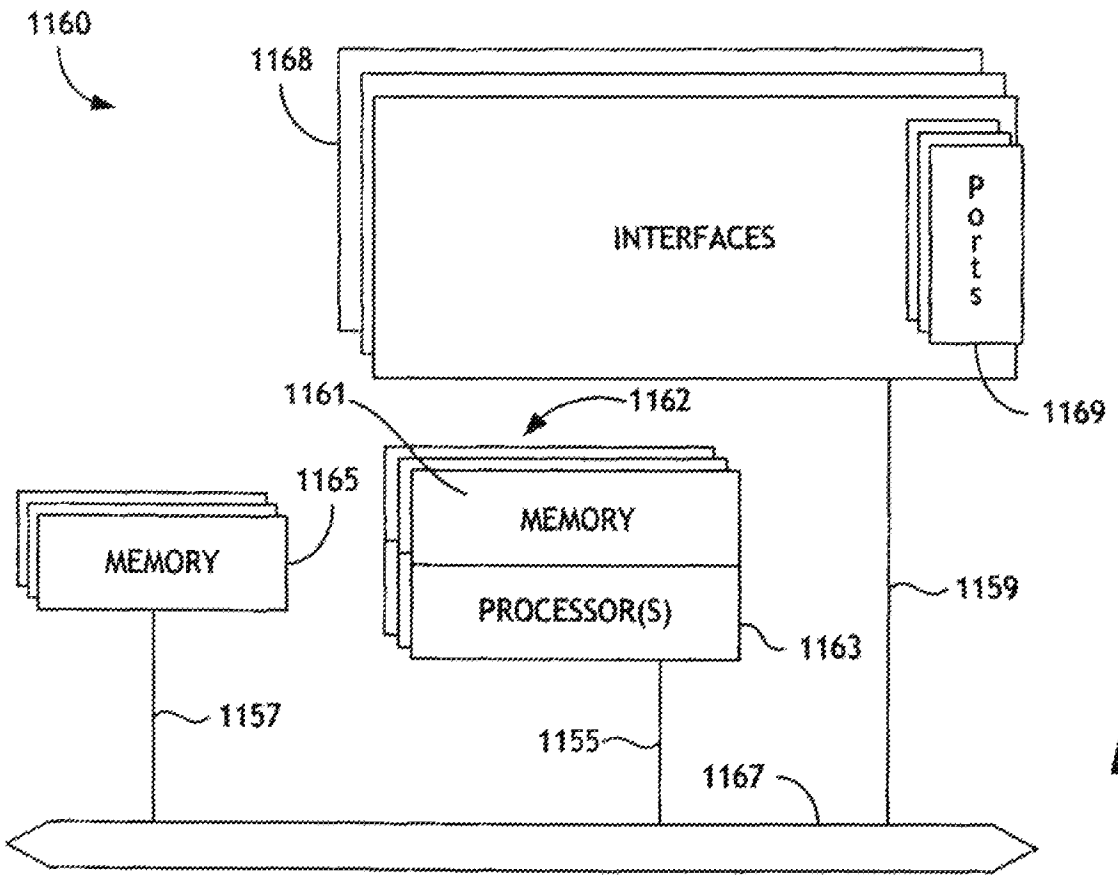
FIG. 1B shows another schematic for an electronic system for enabling play of the gaming method described herein.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

The CPU system may perform additional functions unique to the operation of the present gaming system. The CPU may be engaged with flow meters to measure rates or flow of liquid, volume of total water in the system (by measuring volume in the reservoir when a lowest amount of fluid is in the container and pipes, determination of proportionate payouts dependent upon fluid levels and execution of unique game code. A densitometer in the fluid flow path may be present to determine deterioration in color density or discoloration of the fluid due to contamination, and an alarm is sounded when the color quality (density, tone, wavelengths of absorption and the like) varies beyond predetermined parameters.

There is also a likelihood that a side bet may be used with the underlying technology of the method, referred to as Rapid Bacc™ wagering game. Other variations, alternatives and modifications may be practiced by the skilled artisan within the scope of the present invention.

What is claimed is:

1. A method of playing a simplified wagering game using playing card symbols to determine a random event outcome on a video gaming system having a video display, processor, player input controls and cash system selected from the group consisting of currency validators, coin acceptors, and ticket-in-ticket-out scanner and printer, the method comprising:

a) the processor recognizing a wager placed through the player input controls from credit stored after cash value entry to the video gaming system through the cash system on at least one of a virtual player hand win, a virtual banker hand win or a virtual player hand-banker hand tie event according to a final digit point count in the player hand and the banker hand;

b) the processor running instructions to generate the game of chance from an EPROM or other form of non-volatile memory, thereby providing exactly two random standard virtual playing cards face-up from a set of playing cards to a virtual player position to form a first reduced set of virtual playing cards as the player hand;

c) the processor running instructions to generate the game of chance from an EPROM or other form of non-volatile memory, thereby providing exactly one first random standard playing card face up from the first reduced set of virtual playing cards to a virtual banker position to form a second set of reduced virtual playing cards as the virtual dealer hand;

d) the processor running instructions to generate the game of chance from an EPROM or other form of non-volatile memory, thereby providing exactly one additional random standard virtual playing card face up to the virtual banker position from the second set of reduced virtual playing cards only when and always when the exactly one first random standard virtual playing card is a no-value playing card of a 10, Jack, Queen or King;

e) the processor running instructions to generate the game of chance from an EPROM or other form of non-volatile memory, thereby summing up point count in each of the virtual player hand and the virtual banker hand separately, and valuing the virtual player hand and the virtual banker hand according to a last digit only in summed up point count;

f) the processor running instructions to generate the game of chance from an EPROM or other form of non-volatile memory, thereby determining outcomes in a comparison between the virtual player hand and the virtual banker hand as follows:

i) a higher summed up point count in the virtual player hand as compared to the summed up point count in the virtual banker hand is a winning outcome for the virtual player hand;

ii) a higher summed up point count in the virtual banker hand as compared to the summed up point count in the virtual player hand is a winning outcome for the banker hand;

iii) an identical summed up point count in the virtual player hand as compared to the summed up point count in the virtual banker hand is a tie outcome for both the virtual player hand and the virtual banker hand;

a) the processor running instructions to generate the game of chance from an EPROM or other form of non-volatile memory, thereby resolving all wagers with payout odds in a) according to outcomes i), ii) or iii) determining the outcome of the wagers.

2. The method of claim 1 wherein each of wagers determined by i) and ii) are resolved by the processor with 1:1 odds.

3. The method of claim 1 wherein a wager determined by i) is resolved by the processor with 1:1 odds and a wager resolved by ii) is resolved by the processor at 1:1 with a single card banker hand and is resolved by the processor with less than 1:1 odds with a banker hand winning outcome based on two playing cards.

4. The method of claim 1 wherein a wager determined by iii) is resolved by the processor with odds of at least 7:1 to 9:1.

5. The method of claim 1 wherein virtual playing card symbols are provided by the processor and displayed on the video display by provision of random virtual playing cards provided from a randomized source of virtual playing cards images stored in the non-volatile memory, and the virtual playing cards are placed one-at-a-time from the source of virtual playing cards to respective virtual player hand position and virtual banker hand position.

6. A system enabling the method of claim 1 comprising on a video gaming system having a video display, processor, player input controls and cash system selected from the group consisting of currency validators, coin acceptors, and ticket-in-ticket-out scanner and printer, a virtual player table with virtual indicia marking a virtual player hand position and a virtual banker position, indicia marking a wagering position for a virtual player hand winning outcome, a virtual banker hand winning outcome, and a tie outcome, and dedicated area on the video display indicating credit status remaining from credit originally input into the cash system.

7. A system enabling the method of claim 2 comprising on a video gaming system having a video display, processor, player input controls and cash system selected from the group consisting of currency validators, coin acceptors, and ticket-in-ticket-out scanner and printer, a virtual player table with virtual indicia marking a virtual player hand position and a virtual banker position, indicia marking a wagering position for a virtual player hand winning outcome, a virtual banker hand winning outcome, and a tie outcome, and dedicated area on the video display indicating credit status remaining from credit originally input into the cash system.

8. A system enabling the method of claim 3 comprising on a video gaming system having a video display, processor, player input controls and cash system selected from the group consisting of currency validators, coin acceptors, and ticket-in-ticket-out scanner and printer, a virtual player table with virtual indicia marking a virtual player hand position and a virtual banker position, indicia marking a wagering position for a virtual player hand winning outcome, a virtual banker hand winning outcome, and a tie outcome, and dedicated area on the video display indicating credit status remaining from credit originally input into the cash system.

9. The method of claim 1 wherein each of wagers determined by i) and ii) are resolved by the processor with 1:1 odds, except where ii) is a winning outcome with two banker hand cards, and the odds are then 1:2.

10. The method of playing a simplified wagering game according to claim 1 further comprising:

wherein if one of the virtual playing cards provided in b) and c) is an 8 or 9 value card and has a higher single card count value higher than the other hand, the virtual player hand or virtual dealer hand holding that 8 or 9 value card is a winning outcome on the initial wager on that hand; and further wherein if the virtual playing cards in either hand provided in b) and c) do not have a value of 8 or 9 and are not of equal value:

d) the processor providing exactly one additional random standard virtual playing card face up to the virtual player or the virtual banker position having a lowest count and the hand with the highest final point value or point total wins the hand and a tie in point count is a push on all wagers; and further wherein when the virtual playing cards dealt in b) and c) are of equal count, a third random virtual playing card is dealt face-up, wherein if the value of the third virtual random playing card is a specific, preselected value, wagers on both hands lose, and if the value of the third virtual random playing card is any other value than the specific, preselected value, wagers on both the virtual player hand and the virtual banker push.

11. The method of claim 10 wherein the specific, preselected value is 4.

12. The method of claim 10 wherein in addition to the initial wager, a side bet wager is recognized after equal counts are provided in dealt random cards in b) and c).

13. The method of claim 12 wherein the side bet wager is placed at a location on a gaming table identifying a location for placement of the side bet wager.

14. The method of claim 12 wherein the side bet wager is resolved by paying 2:1 on the side bet for a first specific single virtual playing card value and at least 7:1 on the side bet for a second single virtual playing card value different from the first specific single virtual playing card value, and the side bet loses for any virtual playing card value other than the first specific single virtual playing card value and the second specific single virtual playing card value.

15. The method of claim 13 wherein the side bet wager is resolved by paying 2:1 on the side bet for a first specific single card value and at least 7:1 on the side bet for a second single card value different from the first specific single card value, and the side bet loses for any card value other than the first specific single card value and the second specific single card value.

* * * * *